US007364057B2

(12) United States Patent
Carroll

(10) Patent No.: US 7,364,057 B2
(45) Date of Patent: Apr. 29, 2008

(54) MULTIPLE MAGAZINE CARRIER AND DISPENSER FOR FIREARMS

(76) Inventor: Sean P. Carroll, P.O. Box 280, Plymouth, VT (US) 05056

( * ) Notice: Subject to any disclaimer, the term of this patent is extended or adjusted under 35 U.S.C. 154(b) by 600 days.

(21) Appl. No.: 10/932,067

(22) Filed: Sep. 2, 2004

(65) Prior Publication Data

US 2006/0043137 A1 Mar. 2, 2006

(51) Int. Cl.
*B65D 83/00* (2006.01)
*F41A 9/61* (2006.01)

(52) U.S. Cl. ..... 224/196; 224/931; 42/87; 221/309

(58) Field of Classification Search ..... 224/196, 224/239, 625, 648, 931; 221/185; 42/87, 42/88

See application file for complete search history.

(56) References Cited

U.S. PATENT DOCUMENTS

| | | | | | |
|---|---|---|---|---|---|
| 162,481 | A | | 4/1875 | Lee | |
| 225,169 | A | * | 3/1880 | Sauerbrey | 224/196 |
| 287,804 | A | * | 11/1883 | Collins | 221/185 |
| 501,642 | A | * | 7/1893 | Barton | 224/196 |
| 1,175,907 | A | * | 3/1916 | Slade | 221/185 |
| 1,526,847 | A | | 2/1925 | Fritz | |
| 2,499,652 | A | * | 3/1950 | Kirby | 221/276 |
| 2,837,258 | A | * | 6/1958 | Williams | 221/289 |
| 2,902,196 | A | * | 9/1959 | Gray | 221/268 |
| 3,219,244 | A | * | 11/1965 | Blask | 221/310 |
| 3,263,806 | A | * | 8/1966 | Ring | 206/427 |
| 3,623,256 | A | | 11/1971 | Shiplee, III | |
| 3,883,041 | A | | 5/1975 | Olson | |
| 4,484,404 | A | | 11/1984 | Johnson | |
| 4,583,659 | A | * | 4/1986 | Carter | 221/279 |
| 4,685,600 | A | | 8/1987 | Reuschel | |
| 4,799,323 | A | | 1/1989 | Musgrave | |
| 4,940,135 | A | | 7/1990 | Hall | |
| 5,127,565 | A | | 7/1992 | Grant | |
| 5,676,241 | A | | 10/1997 | Degoix et al. | |
| 6,000,589 | A | | 12/1999 | Burdine | |
| 6,202,908 | B1 | | 3/2001 | Groover | |
| 6,327,805 | B1 | | 12/2001 | Clifton, Jr. | |
| 6,364,157 | B1 | * | 4/2002 | Tosspon | 221/191 |
| 6,668,479 | B1 | | 12/2003 | Obong | |
| 6,817,135 | B1 | * | 11/2004 | Jackson | 42/87 |
| 2003/0200693 | A1 | | 10/2003 | Seifert | |
| 2005/0017043 | A1 | * | 1/2005 | Link et al. | 224/674 |

FOREIGN PATENT DOCUMENTS

| | | |
|---|---|---|
| GB | 572628 | 10/1945 |
| GB | 1079193 | 8/1967 |

* cited by examiner

*Primary Examiner*—Nathan J. Newhouse
*Assistant Examiner*—Justin M Larson
(74) *Attorney, Agent, or Firm*—Richard C. Litman

(57) ABSTRACT

The multiple magazine carrier and dispenser for firearms is configured for rapidly dispensing ammunition magazines in a proper orientation to facilitate rapid reloading of a weapon. The multiple magazine carrier may be curved for either left or right hand use or may be uncurved, and carried on a torso and shoulder strap harness, vest, or other garment, as desired. The carrier has a thickness and height only slightly greater than those dimensions of a magazine, but has a length sufficient for the installation of a series of magazines therein in a front to back orientation. A spring and push plate or shoe urge the magazines toward the front of the device, where a dispensing opening is configured to facilitate grasping the first magazine in line in the proper orientation for rapid installation in a weapon carried by the user.

18 Claims, 5 Drawing Sheets

MULTIPLE MAGAZINE CARRIER AND DISPENSER FOR FIREARMS

BACKGROUND OF THE INVENTION

1. Field of the Invention

The present invention relates generally to handheld firearms, i.e., rifles, pistols, shotguns, and the like, and more specifically to a carrier and dispenser for containing a series of ammunition magazines for such a firearm. The present magazine dispenser is worn upon the torso of the user, and delivers magazines sequentially in an orientation to facilitate their rapid retrieval and insertion in the firearm without undue searching, manipulation, and/or need to look away from the threat or target.

2. Description of the Related Art

Innumerable ammunition and magazine belts, pouches, vests, jackets, etc. have been developed in the past for the carriage of individual rounds and magazines (clips) for firearms. All of these devices have a common purpose, i.e., the temporary storage of ammunition either in the form of individual rounds or cartridges or contained in magazines or clips for placement in weapons configured to accept such magazines. In many instances, the ammunition is stored as individual rounds in a series of loops on a belt, bandolier or the like. While such individual round or cartridge storage systems may be used to store and dispense ammunition for weapons which also accept multiple cartridge magazines, the use of single round storage systems is not acceptable in most police and/or military combat situations due to the potential need for rapid and/or continuous fire. Accordingly, such single round ammunition storage and carriage devices are not considered to be particularly closely related to the present invention.

Insofar as the various magazine pouches and holders of the related art are concerned, such devices universally store perhaps only one or two magazines in each of a series of individual pouches or containers on or in a vest, belt, or other garment. A number of such devices are known to the present inventor and are discussed in detail further below. The problem with such devices is that they are incapable of rapidly delivering a series of magazines sequentially to the user on demand, with each of the magazines being properly oriented for rapid insertion into the firearm to minimize the time that the user is vulnerable. With such previously known magazine storage and carriage devices, the user can generally retrieve only one or two magazines from any single pouch or pocket, whereupon he or she must then locate another pouch or pocket containing full magazines. Moreover, such magazine storage pouches or pockets are generally configured for efficient storage space, rather than to orient the magazines to facilitate their rapid handling and insertion in the weapon.

The present invention responds to these problems by providing a multiple magazine carrier and dispenser for firearms, which contains a series of magazines placed sequentially in a relatively long holder or container which is carried about the torso of the user. The magazines are urged toward the dispensing end of the device by a spring within the dispenser, with each magazine being oriented to facilitate the rapid acquisition of the magazine and its insertion into the firearm without undue manipulation and lost time. The present magazine holder and dispenser thus saves considerable time when reloading as compared to other magazine holders of the related art in situations where a matter of a second or less may be of life and death importance.

A discussion of the related art of which the present inventor is aware, and its differences and distinctions from the present invention, is provided below.

U.S. Pat. No. 162,481 issued on Apr. 27, 1875 to James Lee, titled "Improvement In Cartridge-Boxes," describes a belt and bandolier cartridge holder which may hold one or two cartridge boxes. However, the boxes are not magazines, as they cannot feed rounds directly into the firing chamber of a firearm. An alternative embodiment provides more tightly curved containers wrapped circumferentially about the base of the forestock of a firearm, adjacent the chamber. Again, this embodiment does not serve as a magazine or magazines as it only contains a number of individual rounds and does not feed them into the firing chamber of the weapon, as provided by magazines carried by the magazine carrier and dispenser of the present invention.

U.S. Pat. No. 1,526,847 issued on Feb. 17, 1925 to Lewis Fritz, titled "Rifle," describes a rifle having a stock with a series of separate pockets or receptacles therein. Each of the pockets may contain a single magazine therein. While it is convenient to carry the magazines integrally with the weapon, the problem here is that each magazine is stored and accessed in a separate pocket or receptacle, rather than being accessed from a common outlet or dispensing end of a single holder, as in the present invention.

U.S. Pat. No. 3,623,256 issued on Nov. 30, 1971 to Lewis D. Shiplee III, titled "Ammunition Magazine Holder," describes an attachment which secures two magazines together in an opposed, laterally joined relationship. A user of the '256 holder withdraws the spent magazine from the weapon and flips the magazine and holder assembly over end for end to insert the opposed dispensing end of the second magazine into the weapon. The general concept of the '256 magazine holder is old, with two magazines being secured together in the past in a similar relationship using duct tape or the like. In any event, the '256 holder holds only two magazines together and cannot hold more than two magazines in identical orientations to facilitate rapid reloading of a weapon, as provided by the present invention.

U.S. Pat. No. 3,883,041 issued on May 13, 1975 to Gordon G. Olson, titled "Ammunition Cartridge Dispenser," describes a single magazine for holding a series of cartridges (e.g., shotgun shells) therein. A belt loop or clip extends from one side of the device to permit it to be carried on a belt or the like. No container or holder for carrying and dispensing a series of magazines, each magazine containing a series of cartridges or rounds therein, is disclosed by Olson.

U.S. Pat. No. 4,484,404 issued on Nov. 27, 1984 to David A. Johnson, titled "Spare Magazine Holder," describes a magazine receptacle which is essentially permanently installed upon the weapon, e.g., an M-16 automatic rifle. The Johnson magazine holder or receptacle holds a magazine in the same orientation as when installed in the weapon, thereby facilitating access and installation of the second magazine. However, the Johnson magazine holder is incapable of holding more than a single magazine, thereby greatly limiting the potential firepower of a person using the Johnson device.

U.S. Pat. No. 4,685,600 issued on Aug. 11, 1987 to Donald L. Reuschel, titled "Cartridge Carrier And Dispenser," describes a narrow, elongate, arcuate, cylindrical device for holding and dispensing a series of individual cartridges, e.g., shotgun shells. The Reuschel dispenser is formed of a semi-rigid material, and is carried under the arm by an over-the-shoulder sling. The Reuschel cartridge carrier can carry only a series of individual rounds or shells; it is incapable of carrying a series of magazines each carrying a series of rounds therein, as provided by the present invention.

U.S. Pat. No. 4,799,323 issued on Jan. 24, 1989 to Daniel D. Musgrave, titled "Magazine Carrier For Use On Firearms Or Other Support," describes a housing or holder for a single magazine. The device includes a latch mechanism to hold the magazine therein, and a quick release mechanism for the latch. Musgrave states that the magazine is "in a correct orientation for insertion into a firearm" (abstract), but no firearm or other attachment is disclosed specifically to show the orientation of his magazine holder therewith. Also, while Musgrave states that his carrier may be used with a firearm or attached to some other support, he provides for the carriage or storage of only a single magazine therein, rather than a series of magazines, as provided by the present invention.

U.S. Pat. No. 4,940,135 issued on Jul. 10, 1990 to Dennis C. Hall, titled "Cartridge Holder," describes an elongate tube for the carriage of a plurality of rounds or cartridges therein in a sequential linear array. A single such device does not strictly comprise a magazine, as the device does not automatically feed rounds into the chamber of the firearm. While FIGS. 6 and 7 of the Hall disclosure show a cylindrical container or quiver for the carriage of multiple cartridge holders, the container does not hold a series of magazines nor does it provide for the proper orientation of the tubular cartridge holders for rapid loading into a weapon.

U.S. Pat. No. 5,127,565 issued on Jul. 7, 1992 to Kieran P. Grant, titled "Ammunition Dispensing Garment," describes a hunting vest or the like having a series of open-ended cartridge or shell holding tubes disposed vertically thereon. The upper ends of the tubes are covered by openable flaps to allow for the insertion of cartridges into the tubes and to retain them in the tubes. The opposite bottom ends of the tubes each have a resilient retainer therein to hold the lowermost cartridge or shell within the tube until it is intentionally withdrawn. These tubes are not magazines, as they cannot feed cartridges or rounds directly into the chamber of a weapon. Moreover, Grant does not provide for the carriage of a series of such magazines, but only for the carriage of a series of individual rounds or cartridges.

U.S. Pat. No. 5,676,241 issued on Oct. 14, 1997 to Christophe Degoix et al., titled "Holder For Plural Ammunition Magazines," describes an open top container for holding two magazines. The upper or discharge ends of the magazines are separated, either by spacing the two magazines apart from one another in a parallel array or by splaying the upper ends angularly apart from one another. This provides clearance for the unused magazine from the action of the weapon when one magazine is inserted into the weapon. The Degoix et al. magazine holder is thus more closely related to Shiplee III '256 U.S. Patent, discussed further above, than it is to the present invention with its stacked array of magazines in a single carrier and dispenser which is worn on the torso of the user.

U.S. Pat. No. 6,000,589 issued on Dec. 14, 1999 to John M. Burdine, titled "Automatic Clip Holder," describes a box-like structure having a magazine or clip insertion and dispensing slot or opening at one end, with springs disposed in the opposite end to urge the magazines or clips toward the dispensing end. The clips or magazines are oriented parallel to one another in the Burdine holder, but the Burdine holder includes a belt clip for hooking the holder to the belt of a user rather than being worn on the torso, as in the case of the present invention.

U.S. Pat. No. 6,202,908 issued on Mar. 20, 2001 to J. Steven Groover, titled "Spare Magazine Carrier With Retractable Flap," describes a single or dual magazine carrier having an elastic member(s) in tension below the magazine(s). The elastic urges one of two flaps securing each magazine to a retracted position when not fastened. The device is adapted for carriage upon the belt of a user, rather than on the torso, as in the present invention. Also, it is noted that the present magazine carrier and dispenser is capable of carrying more than two magazines, and those magazines are dispensed sequentially rather than independently of one another, as in the Groover magazine carrier.

U.S. Pat. No. 6,327,805 issued on Dec. 11, 2001 to Norman E. Clifton, Jr., titled "Double Magazine Clamping Device," describes a bracket or clamp and strap assembly which secures two magazines together in a spaced apart, parallel relationship. The result is much like that of the Degoix et al. '241 U.S. Patent, discussed further above, in which two magazines are carried in a common holder and spaced apart from one another to provide clearance from the action of the weapon for the unused magazine when one magazine is inserted in the weapon.

U.S. Patent Publication No. 2003/200,693, published on Oct. 30, 2003, titled "Ambidextrous Reserve Magazine Holder For Firearm," describes a rifle stock having a receptacle in the underside thereof for holding a single magazine therein. A retractable latch secures the magazine removably in the stock receptacle. The '693 rifle and stock more closely resemble the rifle with its multiple magazine receptacles formed in the stock disclosed in the '847 U.S. Patent to Fritz, discussed further above, than it does the present invention.

U.S. Pat. No. 6,668,479 issued on Dec. 30, 2003 to Roberto V. Obong, titled "Firearm Magazine Holder," describes a multiple magazine holder in which the magazines are clamped or secured laterally beside one another, spaced apart in a fixed relationship. The Obong device is more closely related to the magazine holders of the Degoix et al. '241 and Clifton, Jr. '805 U.S. Patents, discussed further above, in that it holds two or more magazines in a fixed relationship with one another, with the entire device being supported by a single magazine inserted in the magazine receptacle of the firearm when the device is in use. In contrast, the present invention comprises a multiple magazine carrier and dispenser which holds a series of magazines but which permits their singular removal from the holder for installation in a firearm, with the magazine dispenser and magazines therein being physically separated from the firearm.

United Kingdom Patent No. 572,628, published Oct. 17, 1945, titled "Improvements In Or Relating To Machine Gun Cartridge Belts, Bandoliers And Similar Cartridge Carriers," describes a disintegrating ammunition belt construction for securing a series of rounds or cartridges together primarily for use in automatic weapons. The belt is similar to others used in automatic weapons, in that the links securing the rounds together disassemble from the shells as the shells are drawn rearwardly by the bolt before being thrust into the firing chamber of the weapon during automatic firing. The device may also be used as an ammunition bandolier or belt, but has no relationship to the multiple magazine carrier and dispenser of the present invention.

Finally, United Kingdom Patent No. 1,079,193, published on Aug. 16, 1967, titled "An Ammunition Dispensing Carrier," describes a magazine-like holder for a plurality of individual rounds or cartridges. The device is not strictly a magazine, as it has no means for securing into the magazine receptacle of a firearm. Rather, the device is adapted to dispense rounds or cartridges individually to the user, whereupon the user may insert the round(s) into the weapon.

None of the above inventions and patents, taken either singly or in combination, is seen to describe the instant invention as claimed. Thus, a multiple magazine carrier and dispenser for firearms solving the aforementioned problems is desired.

SUMMARY OF THE INVENTION

The present multiple magazine carrier and dispenser for firearms provides for the sequential dispensing of a series of ammunition magazines therefrom and orients the magazines properly to facilitate the rapid acquisition and insertion of a loaded magazine into a weapon being carried by the user. The present magazine holder includes a relatively long and narrow passage or channel therein having a thickness only slightly greater than the thickness of a single magazine, and a height only slightly greater than the height of a single magazine. The length allows for the insertion of several magazines therein, in a front-to-back orientation. An elongate compression spring and push plate or shoe are provided in the device to urge magazines toward the front dispensing opening of the device. Several different embodiments of the present invention are provided in left-hand and right-hand configurations, having either a torso and shoulder strap harness attachment or a vest or other apparel attachment. The magazine holders may be curved to fit around the left or right side of the torso as desired, or may be constructed in a straight configuration.

These and other features of the present invention will become readily apparent upon consideration of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention comprises a series of embodiments of a device for the bodily carriage and sequential dispensing of multiple ammunition magazines for firearms. The present invention greatly facilitates the manipulation of magazines for rapid replacement in the magazine well of a firearm, by orienting the magazines for proper insertion in the firearm as they are dispensed from the magazine carrier and dispenser. The result is significantly reduced time required to reload a weapon, which can be critical in a combat situation.

Figure 1:
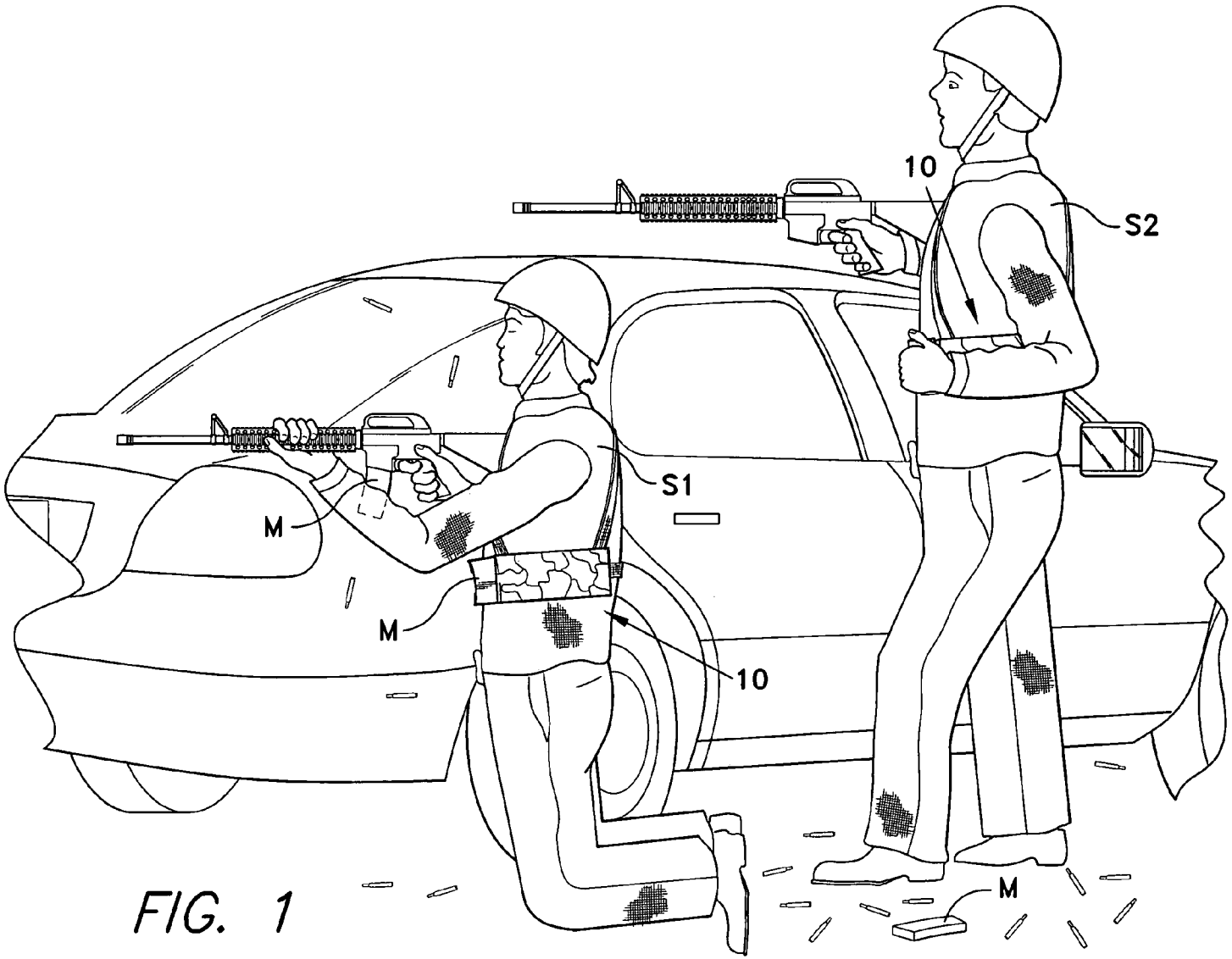
FIG. 1 is an environmental, perspective view showing the operation and use of the present multiple magazine carrier and dispenser in the field.
Figure 2:
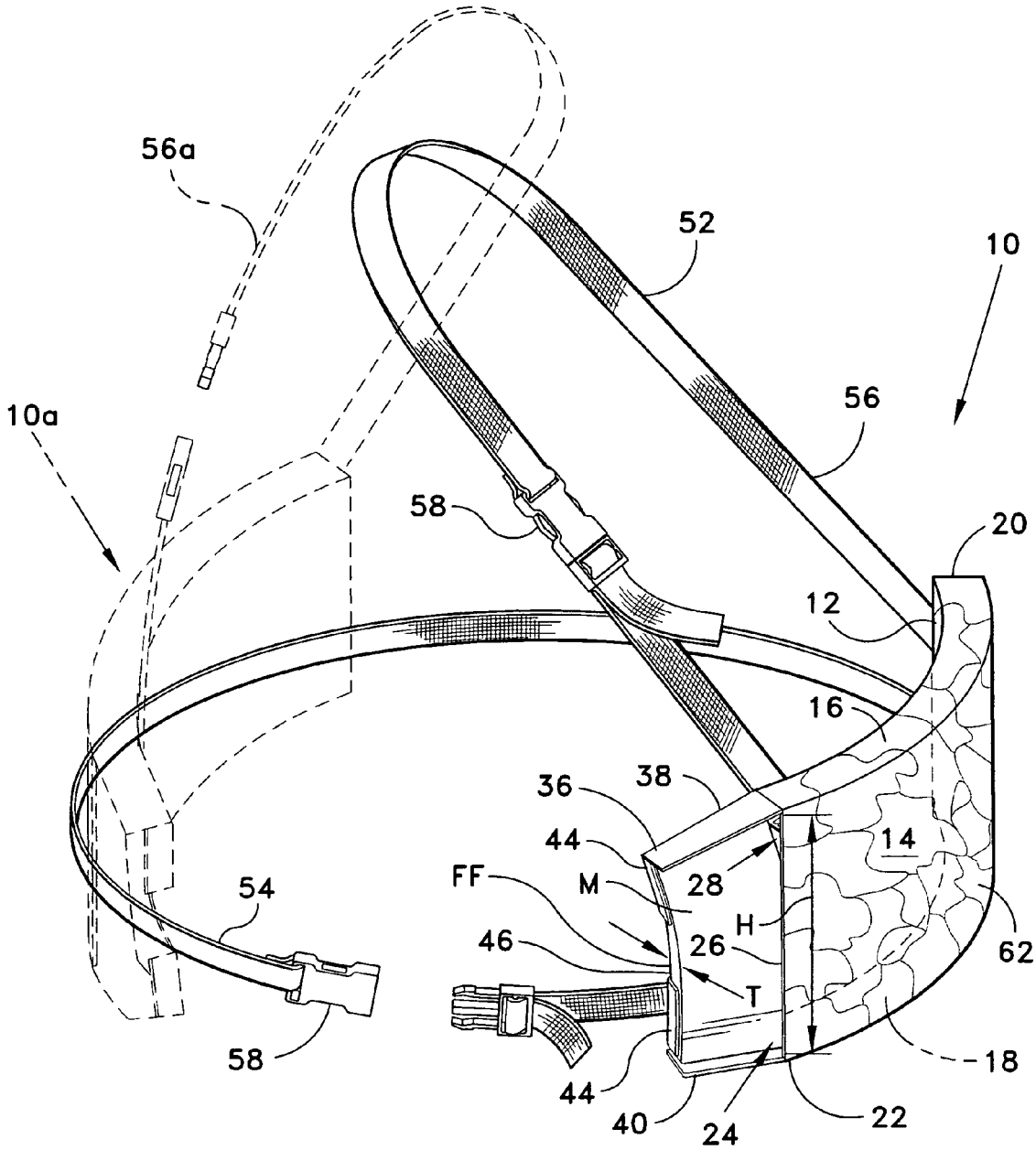
FIG. 2 is a front and top perspective view of a first embodiment of the present multiple magazine carrier, showing a torso and shoulder strap harness attachment therefor.

FIG. 1 provides an environmental perspective view of soldiers S1 and S2 using a first embodiment of the present multiple magazine carriers 10, with FIG. 2 providing a more detailed perspective view of a single carrier 10 and harness therefor. The carrier 10 generally comprises a back wall 12 which bears directly against the torso of a person using the device, an opposite front or outwardly facing wall 14, a relatively narrow top panel 16, and an opposite, relatively narrow bottom panel 18. The walls and panels 12 through 18 define a rectangular cross section configured to fit reasonably closely about the height H and thickness T of a conventional ammunition magazine M.

The rearward end 20 of the carrier 10 is closed, while the opposite forward or dispensing end 22 includes a laterally disposed magazine dispensing opening or passage 24 therein immediately forward of the forward edge 26 of the outwardly facing front wall 14. The above described structure of the magazine carrier and dispenser 10 provides an elongate internal compartment 28 having a height 30 (shown most clearly in FIG. 3) and internal thickness 32 (as shown in FIG. 4) which are slightly larger than the height H and thickness T of the magazines M for which the carrier 10 is configured. It will be understood that the present multiple magazine carrier 10 is not restricted to any specific magazine size or configuration, but may be dimensioned to fit any practicable type and number of firearm magazines.

Figure 4:
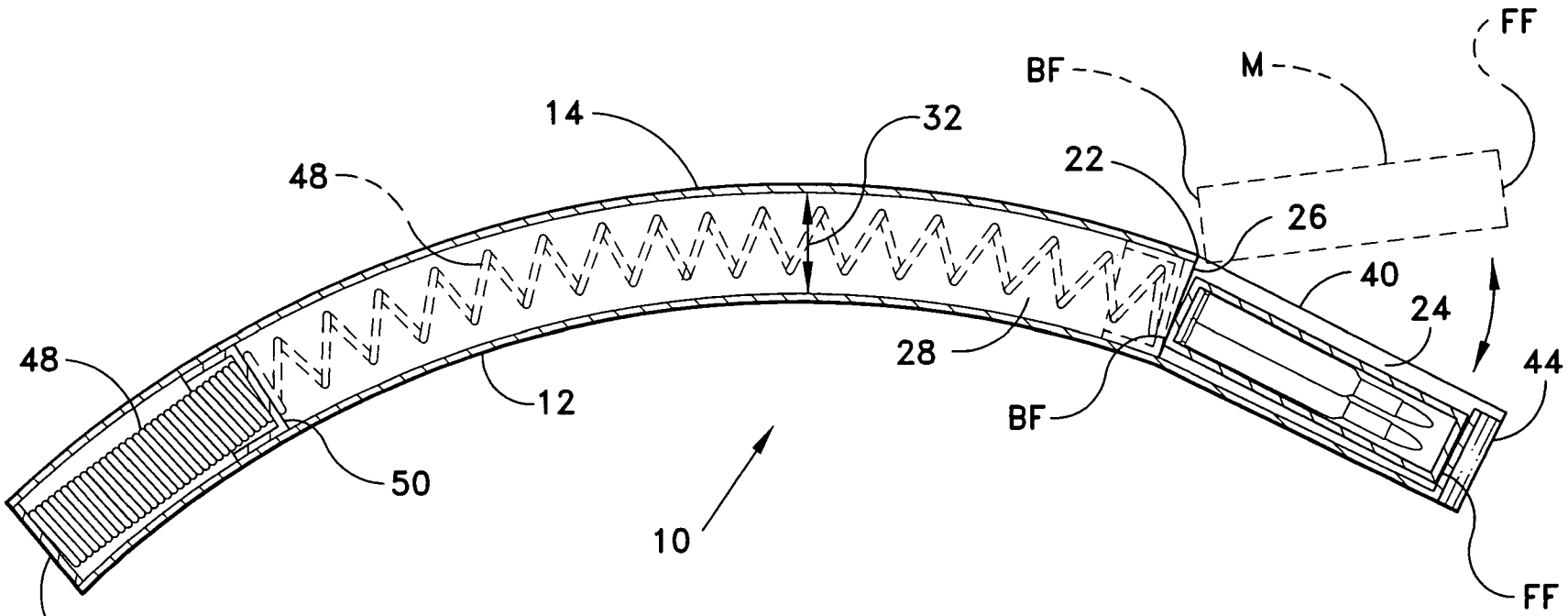
FIG. 4 is a top plan view in section of a left side magazine carrier of the present invention, showing the internal structure thereof.
Figure 5:
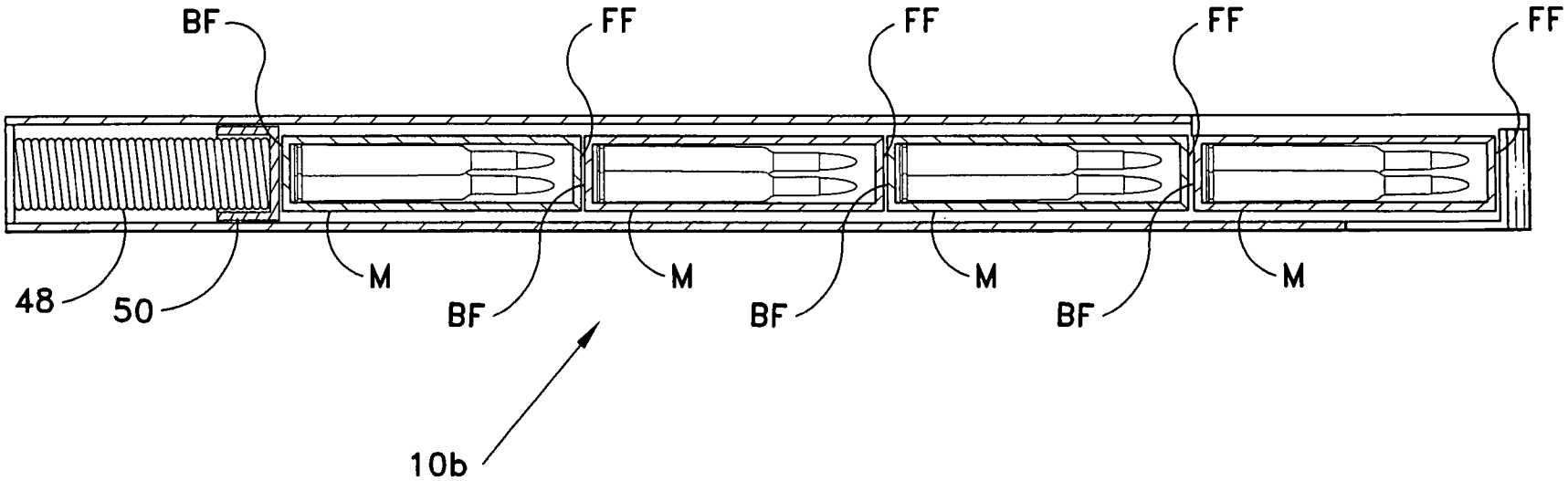
FIG. 5 is a top plan view in section of another embodiment of the present multiple magazine carrier having a straight configuration.

Firearm ammunition magazines. M are placed within the magazine carrier 10 in a linear array, with the relatively narrow front face FF of each magazine M facing forwardly and abutting the back face BF of the next magazine M immediately forward thereof. The top plan view in section of the carrier 10 shown in FIG. 4 provides an illustration of the interior compartment 28 of the carrier 10, and the loading or dispensing of a magazine M (shown in broken lines in FIG. 3) into the dispensing opening 24. FIG. 5 illustrates an alternative embodiment carrier 10*b*, with a series of magazines M loaded therein in a linear front face FF to back face BF relationship, as used in the magazine carrier 10 of FIGS. 1 through 3 as well.

All of the various magazine carrier and dispenser devices of the present invention facilitate the rapid retrieval of a fresh, fully loaded magazine from the device, with the orientation of the magazine providing for the rapid installation of the magazine into the magazine well of a firearm being held by the user. The fixed location of the magazine dispensing outlet 24 in each of the magazine carriers of the present invention assures that a person using any of the present carriers may reach for a fresh magazine at the dispensing outlet 24 with the same consistent motion each time, without having to take his or her eyes off the target or threat to look for a different pocket or other magazine storage area.

Figure 3:
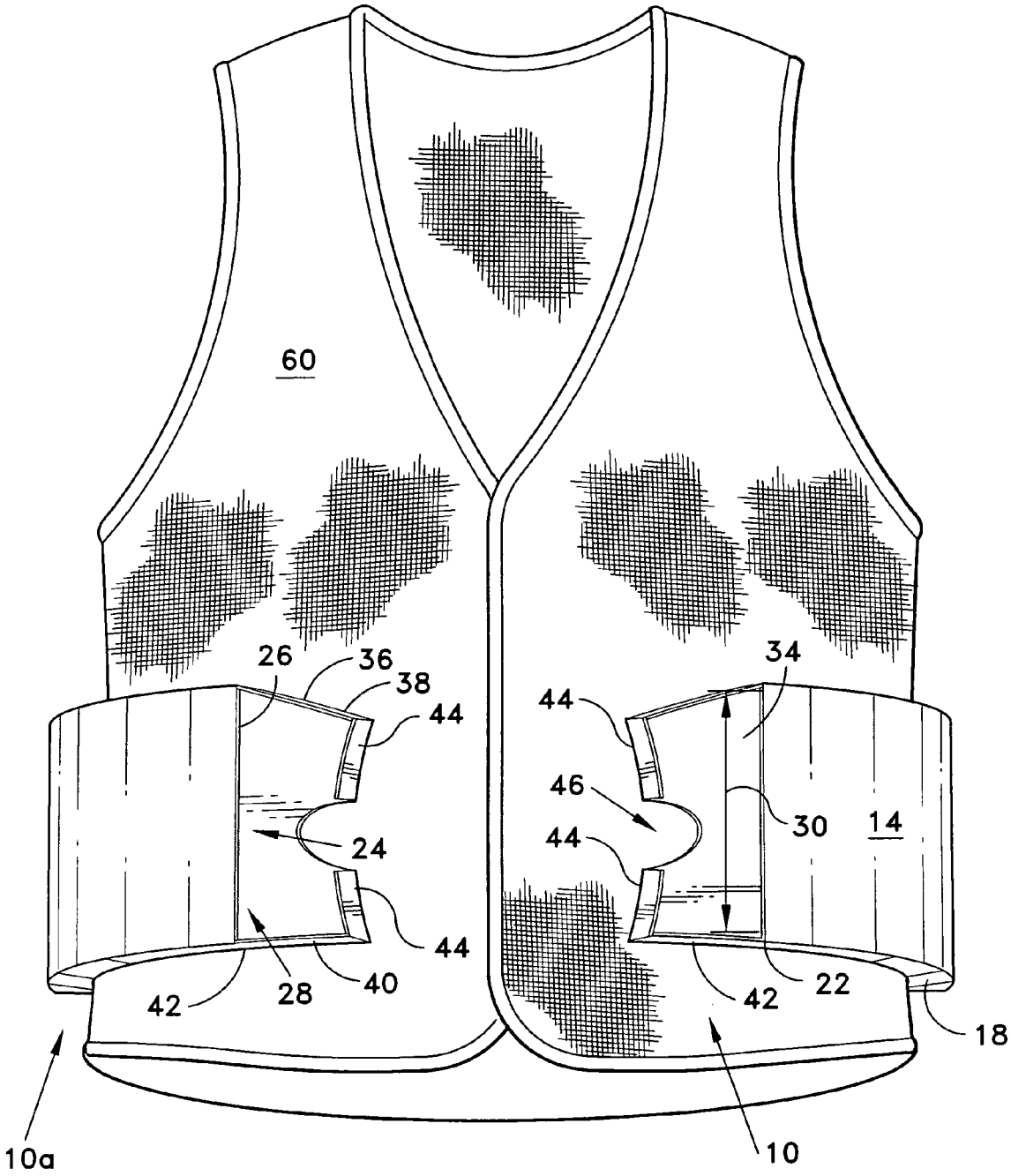
FIG. 3 is a front perspective view of a second embodiment of the present multiple magazine carrier, showing a vest for the carriage of an opposed pair of the carriers.

FIGS. 2 and 3 provide front perspective views respectively of empty and loaded magazine carriers 10, and illustrate the details of the area of the magazine dispensing opening or passage 24. The dispensing opening 24 is defined by a back wall extension 34 which extends forwardly from the back wall 12 of the device, a top panel extension 36 which extends from the upper edge 38 of the back wall extension 34 and the forward end of the top panel 16, a bottom panel extension 40 extending from the lower edge 42 of the back wall extension 34 and the forward end of the bottom panel 18, a front stop flange(s) 44 which extend(s) from the forward end of the back wall extension 34, and the front edge 26 of the front or outboard panel 14 of the device 10.

Preferably, the front stop flanges 44 comprise two separate units, divided by a handgrip relief 46 therein which extends partially across the back wall extension 34. The handgrip relief 46 allows a user of the present magazine carrier 10 to pass one or more of his or her fingers behind the magazine M positioned in the dispensing end 22 of the device 10 and apply outward pressure toward the magazine dispensing opening 24 to dislodge the magazine M therefrom for use. The back wall extension 34 may include an upper edge 38 which is angled forwardly and toward the bottom panel 18, with the lower edge 42 of the back wall extension 34 preferably being coplanar with the bottom panel 18. This configuration provides for the secure holding of a so-called "banana clip," or curved magazine in which the upper end tapers forwardly and toward the lower end in order to provide for the storage of multiple rounds of ammunition having larger diameter shells than their bullet calibers.

FIGS. 4 and 5 illustrate the internal mechanism of the present magazine holder and dispenser 10, as well as showing differently shaped embodiments. However, the internal mechanism is essentially the same in the variously shaped embodiments of the present invention. At least one relatively light compression spring 48 is installed internally within the magazine dispenser 10. Only one such spring 48 is shown in the top plan views of FIGS. 4 and 5, but it will be understood that plural springs 48 installed above and below one another could be provided and would have the appearance shown in the sectional top plan views of FIGS. 4 and 5.

The spring 48 compressibly extends within the internal compartment 28 between the closed rearward end 20 and a sliding magazine dispensing shoe or push plate 50 which may travel from a loaded position shown in solid lines in FIG. 4, to an extended position shown in broken lines in the same figure. The shoe or push plate 50 may include opposed fingers (not shown) which engage cooperating channels or tracks (not shown) to provide smooth operation of the shoe 50 as it travels the length of the internal compartment 28 to push magazines M toward the dispensing opening 24. Other conventional shoe or push plate guide means may be provided as desired. Conventional forwardly disposed stop(s), not shown, may be provided to prevent the push plate 50 from passing beyond the front edge 26 of the front or outboard panel 14 and into the magazine dispensing passage 24. Magazines M are loaded into the device 10 by inserting them through the dispensing opening 24, with the back faces BF of the magazines oriented toward the dispensing shoe 50.

The compression spring(s) 48 applies pressure to the shoe 50 and against the back face BF of the first magazine M loaded into the device 10, with that magazine M transferring pressure to other magazines M within the device to urge or push them toward the dispensing opening 24. The first magazine M in line, i.e., the magazine at the dispensing opening 24, is prevented from further travel by the forwardly and downwardly angled top panel extension 36, as shown in FIGS. 2 and 3, and further by the front stop flanges 44. Yet, the first magazine in line at the dispensing outlet 24 is readily grasped by a person wearing the present magazine holder and dispenser 10, with the next magazine M in line being pushed forward by the action of the compression spring 48 and shoe 50 as the first magazine M is removed from the device.

The primary embodiments of the present invention are configured ergonomically for greater comfort and ease of use by the person using the device. FIGS. 2 and 3 clearly illustrate the curvature of the first embodiment 10, which has a right hand curvature from the rear end 20 to the dispensing end 22 when viewed from above. This curvature conforms to the left side of the torso of the user of the device 10, allowing the device to be worn close to the body and secured in place with minimal looseness or play. This is important, as it assures that the dispensing outlet 24 always remains in a constant position relative to the body of the user, so the user may reach for a fresh magazine at the dispensing opening with confidence that the device has not shifted. Also, the weight of a series of fully loaded magazines is significant, and the curvature of the present magazine carrier and dispenser 10 assists in assuring that the device will remain in a secure position about the torso of the user. The placement of the dispensing opening 24 at the left front of the user around the torso, enables the user to continue to support a shoulder held firearm with the right hand while reaching downwardly with the left hand to retrieve a fresh magazine from the device 10, generally as shown by the soldier to the right side of FIG. 1. The orientation of the magazine M facing forwardly in the device 10 assures the user that the magazine is in the proper orientation for insertion in the firearm magazine well, with no additional reorienting or manipulation of the magazine being required, or glancing away from the target or threat to assure proper orientation of the magazine.

The above-described left side magazine carrier and dispenser 10 is particularly well adapted for right-handed shooters, wherein the firearm is supported and operated by the right hand and the left hand is used to change magazines. However, left-handed shooters will prefer an oppositely curved configuration, in which the device is curved to the left from its rearward end to its dispensing end when viewed from above. Such a configuration is illustrated in broken lines in FIG. 2 and in solid lines in FIG. 3 of the drawings, and is designated as multiple magazine carrier and dispenser 10*a*. It will be seen that the devices 10 and 10*a* are mirror images of one another, with all components being identical (e.g., the internal spring and shoe mechanism) or mirror images (e.g., the inboard and outboard walls) to one another. The magazine carrier and dispenser 10*a* is well suited for use by left-handed shooters, and is worn laterally about the right side of the torso where magazines may be extracted therefrom by the right hand of the user.

In some instances, it may be desirable to provide an embodiment of the present invention in a straight, uncurved configuration. Such an uncurved magazine holder and dispenser is shown in FIG. 5 of the drawings, and designated as magazine carrier and dispenser 10*b*. Again, the various operable components of the dispenser 10*b* are identical to those of the magazine dispensers 10 and 10*a*, or differ only in the lack of curvature. Such a straight magazine holder and dispenser 10*b* may be valuable as a fixed installation, e.g., within an armored vehicle or other location from which it may be necessary to direct fire from time to time. The straight magazine dispenser 10*b* may also be carried on the person, if so desired, but its orientation is not so convenient as the curved magazine holders 10 and 10*a* illustrated in FIGS. 1 through 4 and discussed further above.

The magazine holder and dispenser 10*b* illustrated in FIG. 5 is shown with a series of four magazines placed therein. A carrier length providing for a maximum of four magazines is likely optimal for most situations. However, it will be seen that this is not an absolute limitation. Shorter magazine holders may be constructed in accordance with the present invention, perhaps holding only two or three magazines. Alternatively, the device could be constructed with a greater length in any of its variously curved or uncurved embodiments, to carry more than four magazines if so desired.

The present multiple magazine carrier and dispenser, particularly in its curved, torso conforming configurations, is particularly well adapted for carriage on the body of the user. Accordingly, means is provided for the removable securing of the magazine carrier and dispenser to the torso of the user. FIG. 2 illustrates one embodiment of such means, comprising a waist and shoulder harness assembly 52. The harness assembly 52 includes a circumferential belt or strap 54 to which the carrier and dispenser 10 is attached, and a diagonal shoulder strap 56 extending from the upper front and rear portions of the carrier and dispenser 10. Conventional adjustable buckles 58, e.g., side latch buckles or other connecting means, are provided to allow the harness 52 to be donned and removed. A second, mirror image magazine carrier and dispenser 10*a*, shown in broken lines in FIG. 2, may be provided along the right side of the belt 54, with a second, oppositely deployed shoulder strap 56*a* being provided for the dispenser 10*a*. Other harness configurations, e.g., vertical shoulder straps with lateral connecting members generally forming an "H" configuration to the front and/or back of the wearer, may be provided for the carriage of the present magazine carrier and dispenser 10 and/or 10*a*, as desired.

FIG. 3 illustrates another embodiment for the carriage of the present invention on the person, comprising a support garment 60 to which the magazine carrier 10 and/or 10*a* is attached. The support garment 60 serves the same purpose as the harness 52 of FIG. 2, but may provide other functions as well, e.g., comprising body armor for additional protection, or perhaps having additional pockets or storage means therewith for additional equipment, etc. The specific configuration of the support garment 60 of FIG. 3 is not critical. The primary point is that both the harness 52 of FIG. 2 and the support garment 60 of FIG. 3 provide for the support and carriage of one or more of the multiple magazine carriers and dispensers of the present invention.

In conclusion, the present multiple magazine carrier and dispenser in its various embodiments, provides a much needed means for soldiers, police, and others who may have need to employ sustained firepower at a target or threat to maintain essentially continuous fire at the target or threat. The time required for the user of the present invention to reload his or her weapon with a fresh magazine is considerably reduced over older, conventional systems. With such older systems comprising one or more rectangular pouches attached to a harness, the various pouches are located in different positions, requiring the user to reach to different areas to access magazines from each pouch as they were used. In addition, conventional pouches require the user to manipulate some form of fastener to open the pouch before a magazine can be retrieved. Also, the magazines stored in such pouches are nearly certain to be at some inconvenient orientation, requiring some additional time spent to manipulate the magazine to the proper orientation for insertion in the magazine well of the weapon. The conventional magazine pouch must be closed again after removing a magazine therefrom in order to prevent loss of the remaining magazines therefrom. Such conventional magazine pouches can also destroy the element of stealth if they are only partially filled, as two or more magazines knocking against one another generate noise as the person moves.

The present invention provides a solution to all of the above problems, assuring the user that a fresh magazine is always available at a specific, unchanging location relative to the user, i.e., the magazine dispensing opening of the carrier. The present magazine carrier and dispenser in its various embodiments does not require the release of any form of latch, cover, or other restraint for the magazines being held therein. Rather, the upper and lower panel extensions and the front stop flanges assure that the magazine remains in place at the dispensing opening, ready for prompt removal therefrom as desired. Moreover, all of the magazines are dispensed in proper orientation, i.e., with the front face of the magazine facing forwardly relative to the user, so the user need only release the empty magazine from the weapon, reach downwardly to grasp a fresh magazine from the carrier, and maintain that same orientation of the fresh magazine as it is brought up to the weapon for insertion in the magazine well. Thus, the time required to change magazines in the weapon is greatly reduced using the present invention, and the user need not take his or her eyes from the target or threat during the operation.

The present magazine holder and dispenser also provides for stealthy operation, as any magazines contained therein are biased in place by the compression spring therein and cannot rattle loosely within the device. Greater stealth may be provided as required by applying an unobtrusive finish 62 to the device, e.g., a camouflage pattern as shown clearly in FIG. 2, or perhaps a flat black coating or cover for night operations, etc. as desired. Accordingly, the present multiple magazine carrier and dispenser for firearms will prove to be a most valuable tool for military, police, and other personnel who may have occasion to provide substantial small arms firepower from time to time.

It is to be understood that the present invention is not limited to the embodiments described above, but encompasses any and all embodiments within the scope of the following claims.

I claim:

1. A multiple magazine carrier and dispenser for a firearm using ammunition magazines, each of the magazines having a width, a height, a thickness, a narrow front face, and a narrow back face, the carrier and dispenser comprising:

a multiple magazine container having a back wall, a front wall opposite the back wall, a top panel, a bottom panel opposite the top panel, a forward end, and a closed rearward end opposite the forward end, each wall and each panel defining a closed, substantially rectangular cross section;

said container defining a firearm magazine compartment dimensioned and configured for containing a plurality of the magazines in a linear, front face to back face relationship;

the front wall of said container further having a forward edge and a magazine dispensing lateral opening disposed forwardly thereof;

a back wall extension opposite the lateral opening having a top edge, a planar top panel extension extending from the top edge of the back wall extension and from the top panel, wherein the top edge and planar top panel extension are angled forwardly and toward the bottom panel and a bottom edge coplanar with the bottom panel;

a bottom panel extension extending from the bottom edge of the back wall extension and from the bottom panel;

a front stop flange extending from said back wall extension and extending from the end of the top edge and top panel extension to form a lateral stop to a magazine located within the container, wherein said front stop flange, said top panel extension, said bottom panel extension, and the forward edge of the forward wall defining an unobstructed magazine dispensing opening;

at least one internal compression spring extending from the closed rearward end; and a magazine dispensing shoe disposed upon said spring adapted for urging the magazines stored within said container toward the magazine dispensing opening thereof.

2. The multiple magazine carrier and dispenser for firearms according to claim 1, wherein said front stop flange and said back wall extension each have a handgrip relief defined therein.

3. The multiple magazine carrier and dispenser for firearms according to claim 1, wherein said container is straight.

4. The multiple magazine carrier and dispenser for firearms according to claim 1, further including a torso and shoulder harness assembly extending from said container.

5. The multiple magazine carrier and dispenser for firearms according to claim 1, further including a support garment, said container being attached thereto.

6. The multiple magazine carrier and dispenser for firearms according to claim 1, further including an unobtrusive finish disposed over at least said container.

7. The multiple magazine carrier and dispenser for firearms according to claim 1, wherein said container has a lateral torso fitting curvature.

8. The multiple magazine carrier and dispenser for firearms according to claim 7, wherein said curvature comprises a right hand curve adapted for wear about a left side torso.

9. The multiple magazine carrier and dispenser for firearms according to claim 7, wherein said curvature comprises a left hand curve adapted for wear about a right side torso.

10. A multiple magazine carrier and dispenser for a firearm using ammunition magazines, each of the magazines having a width, a height, a thickness, a narrow front face, and a narrow back face, the carrier and dispenser comprising:

a multiple magazine container having a back wall, a front wall opposite the back wall, a top panel, a bottom panel opposite the top panel, a forward end, and a closed rearward end opposite the forward end, each wall and each panel defining a closed, substantially rectangular cross section;

the front wall of said container further having a forward edge and a magazine dispensing lateral opening disposed forwardly thereof;

a back wall extension opposite the lateral opening having a top edge, a planar top panel extension extending from the top edge of the back wall extension and from the top panel, wherein the top edge and planar top panel extension are angled forwardly and toward the bottom panel and a bottom edge coplanar with the bottom panel;

a bottom panel extension extending from the bottom edge of the back wall extension and from the bottom panel;

a front stop flange extending from said back wall extension and extending from the end of the top edge and top panel extension to form a lateral stop to a magazine located within the container, wherein said front stop flange, said top panel extension, said bottom panel extension, and the forward edge of the forward wall defining an unobstructed magazine dispensing opening;

at least one internal compression spring extending from the closed rearward end; and a bodily worn multiple magazine container support, said container being attached to the support.

11. The multiple magazine carrier and dispenser for firearms according to claim 10, wherein said bodily worn multiple magazine container support is selected from the group consisting of a torso and shoulder harness assembly and a support garment.

12. The multiple magazine carrier and dispenser for firearms according to claim 10, wherein said container includes a magazine dispensing shoe disposed upon said spring adapted for urging the magazines stored within said container toward the magazine dispensing opening thereof.

13. The multiple magazine carrier and dispenser for firearms according to claim 10, wherein said front stop flange and said back wall extension each further include a handgrip relief defined therein.

14. The multiple magazine carrier and dispenser for firearms according to claim 10, wherein said container is straight.

15. The multiple magazine carrier and dispenser for firearms according to claim 10, further including an unobtrusive finish disposed over at least said container.

16. The multiple magazine carrier and dispenser for firearms according to claim 10, wherein said container has a lateral torso fitting curvature.

17. The multiple magazine carrier and dispenser for firearms according to claim 16, wherein said curvature comprises a right hand curve adapted for wear about a left side torso.

18. The multiple magazine carrier and dispenser for firearms according to claim 16, wherein said curvature comprises a left hand curve adapted for wear about a right side torso.

* * * * *